US006887188B1

(12) United States Patent
Davies

(10) Patent No.: US 6,887,188 B1
(45) Date of Patent: May 3, 2005

(54) VIRTUAL JUMP ROPE

(76) Inventor: Phillip Hugh Davies, 2315 Holly La., Lafayette Hill, PA (US) 19444

( * ) Notice: Subject to any disclaimer, the term of this patent is extended or adjusted under 35 U.S.C. 154(b) by 131 days.

(21) Appl. No.: 09/976,871

(22) Filed: Oct. 12, 2001

(51) Int. Cl.[7] ..... A63B 5/20; A63H 1/05
(52) U.S. Cl. ..... 482/82; 446/247
(58) Field of Search ..... 482/81–82, 121, 482/126, 148, 35–37, 23–24; 119/795–798; 446/247

(56) References Cited

U.S. PATENT DOCUMENTS

| | | | | | |
|---|---|---|---|---|---|
| 1,160,490 | A | * | 11/1915 | Bourikas | 231/2.1 |
| 1,505,473 | A | | 8/1924 | Klubnick | 482/81 |
| 2,223,174 | A | | 11/1940 | Hughes | 482/82 |
| 2,253,075 | A | * | 8/1941 | Johnson | 482/82 |
| 3,249,356 | A | * | 5/1966 | Schweitzer | 482/82 |
| 3,762,704 | A | * | 10/1973 | Gingras | 482/81 |
| 4,092,799 | A | | 6/1978 | Anderson | 446/247 |
| 4,109,906 | A | * | 8/1978 | Wilson | 482/82 |
| 4,218,057 | A | * | 8/1980 | Wilson | 482/93 |
| 4,513,692 | A | * | 4/1985 | Kuhnsman et al. | 119/795 |
| 4,693,469 | A | | 9/1987 | Cedar | 482/81 |
| 5,058,883 | A | | 10/1991 | Dybvik | 482/82 |
| 5,087,220 | A | * | 2/1992 | Cotita | 446/247 |
| D334,605 | S | * | 4/1993 | Forgione | D21/672 |
| 5,215,509 | A | * | 6/1993 | Meyer | 482/82 |
| 5,649,504 | A | * | 7/1997 | Culp | 119/795 |
| 5,749,812 | A | * | 5/1998 | Feciura et al. | 482/82 |
| 5,842,956 | A | | 12/1998 | Strachan | 482/82 |
| 5,895,341 | A | * | 4/1999 | Jones | 482/81 |
| 6,206,537 | B1 | * | 3/2001 | Hauck | 362/102 |
| 6,234,662 | B1 | * | 5/2001 | Blake | 366/129 |
| 6,524,226 | B2 | * | 2/2003 | Kushner | 482/126 |
| 6,540,649 | B1 | * | 4/2003 | Niedrich | 482/82 |

OTHER PUBLICATIONS

Carey, "For Trip Free jump rope, disconnect the middle", Dec. 3, 2001, Philadelphia Inquirer, p 10B.

* cited by examiner

*Primary Examiner*—Jerome W. Donnelly
*Assistant Examiner*—Fenn C. Mathew
(74) *Attorney, Agent, or Firm*—William J. Stoffel

(57) ABSTRACT

An exercise device for simulating jump roping and for providing a total body workout that is held and rotated in use, comprised of two units; each unit to be held in a hand of a user. The units each comprised of (1) a handle, (2) an elongated first element attached to the handle, and (3) the elongated element has at least a first loop. The units preferably include a loop forming device for forming a loop from a portion of the elongated first element. The loop forming device can be located inside or outside the handle. The units can include additional elongated elements or loops. In other preferred embodiments, the exercise units are comprised of: a handle, and an elongated first element attached to the handle, and the elongated element providing weight and air resistance during the rotation of the elongated first element. The invention's easy-to-use jump rope simulator units provide a realistic feel of jumping rope, can be used for many different exercise movements, and are designed with a soft, short cord loop to protect the user from harm from the cord striking the user.

6 Claims, 18 Drawing Sheets

VIRTUAL JUMP ROPE

BACKGROUND OF INVENTION

1) Field of the Invention

This invention relates generally to fitness devices, exercise devices and jump rope simulators and more particularly to a virtual jump rope for providing an exercise workout simulating the jumping of a jump rope as well as for providing a total body workout similar to aerobics.

2) Description of the Prior Art

Jump ropes have been used for years as recreation and/or exercise devices. Although a jump rope may comprise nothing more than a length of an elongated flexible element, such as a rope, it is common practice to attach handles to the opposite ends of the rope to facilitate the rope skipping operation. To prevent the rope from becoming twisted in use, some jump ropes employ bearings for attaching the handles to the ends of the rope. It is known to use bearings of various designs, including ball bearings, for this purpose.

It is also known to add weights to the rope. This may be done to increase the centrifugal force generated in skipping and/or to widen the bottom of the arc of the rope. In this connection, it is known to attach members to the rope and to provide thickened regions along the rope. In any event, the weighted portion of the rope is characteristically, either totally immovable or subject to sliding along the rope due to the centrifugal force exerted thereon in jumping or to other factors. Moreover, the weights may appear unsightly and they add to the cost of the jump rope.

Traditional jump ropes have been popular for users of very high fitness levels, such as professional boxers, but because of the high intensity workout and the difficulty in using jump ropes, many people do not jump rope as part of their exercise workout. In addition, jumping rope is tedious, limited in movements to only do a few basic arm and leg movements which can become boring after jumping rope for awhile. Also, the rope of a traditional jump rope travels under the user's feet and gets caught frequently, even when used by skilled users, which causes frustrating stops & restarts during a workout.

The use of jump rope simulators is known in the prior art. More specifically, jump rope simulators heretofore devised and utilized are known to consist basically of familiar, expected and obvious structural configurations, notwithstanding the myriad of designs encompassed by the crowded prior art which have been developed for the fulfillment of countless objectives and requirements.

While jump rope simulators are known in the prior art, none have been commercially successful. The prior art simulators have been difficult and expensive to manufacture compared to jump ropes. Also the prior art simulators have been unsafe because they can strike and harm the user. Prior art simulators can hit the user on the arms or body with a rotating hard object, or hit the user on the body, head or in the face. Moreover, prior art jump rope simulators are not practical for use in aerobics classes or group exercise workouts because they require a large amount of room and are dangerous as mentioned above.

In these respects, the jump rope simulator according to the present invention substantially departs from the conventional concepts and designs of the prior art, and in so doing provides a safe and enjoyable apparatus primarily developed for the purpose of providing an exercise workout simulating the jumping of a jump rope, as well as for the purpose of providing numerous additional exercises.

The importance of overcoming the various deficiencies noted above is evidenced by the extensive technological development directed to the subject, as documented by the relevant patents. The closest and apparently more relevant developments in the patent literature can be gleaned by considering U.S. Pat. No. 5,895,341 (Jones), U.S. Pat. No. 4,693,469 (Cedar), U.S. Pat. No. 1,505,473 (Klubnick), U.S. Pat. No. 5,842,956 (Strachan), U.S. Pat. No. 4,092,799 (Anderson), U.S. Pat. No. 5,058,883 (Dybvik), U.S. Pat. No. 3,249,356 (Schwietzer) and U.S. Pat. No. 2,223,174 (Huges).

SUMMARY OF THE INVENTION

It is an object of the invention to provide an exercise device.

It is an object of embodiments of the present invention to provide a virtual jump rope exercise device.

It is an object of embodiments of the present invention to provide a virtual jump rope exercise device comprised of an elongated element having a loop.

It is an object of embodiments of the present invention to provide a virtual jump rope exercise device comprised of an elongated element having a means to change the weight or air resistance of the elongated element.

It is another object of embodiments of the present invention to provide a virtual jump rope that doesn't require a rope going under the user's feet and which provides the same exercise as a traditional jump rope, so there is no cord to get caught on the user's feet, and users do not have to stop and restart their exercise.

Still another object of embodiments of the present invention is to provide a jump rope simulator for providing a total body workout including numerous arm and leg movements that can not be performed with a traditional jump rope and which can be used in group exercise activities such as aerobics and can be used while walking or jogging.

It is another object of embodiments of the present invention to provide a jump rope simulator which may be easily and efficiently manufactured and marketed.

It is a further object of embodiments of the present invention to provide a jump rope simulator which is of a durable and reliable construction.

An even further object of embodiments of the present invention is to provide a jump rope simulator which has a low cost of manufacture with regard to both materials and labor, thereby making such jump rope simulator economically available to the buying public.

Still another object of embodiments of the present invention is to provide a jump rope simulator for providing an exercise workout simulating the jumping of a jump rope.

To accomplish the above objectives and other objectives, the embodiments of the present invention provide a jump rope simulator or virtual jump rope. An embodiment of the invention can be characterized as an exercising device that is held and rotated in use. The exercise device of the embodiment is comprised of two units; each unit to be held in a hand of a user; the units each comprised of: a handle, an elongated first element attached to the handle, and the elongated first element has at least a first loop. Other preferred embodiments provide devices that form loops and detachably join loops to the handle. In some embodiments a loop forming device is within the handle while in other embodiments the loop forming device is outside of the handle.

Another embodiment of the invention comprises an exercise device that is held and rotated in use comprised of two units; each unit to be held in each hand of a user; the units each comprised of: a handle, an elongated first element attached to the handle, the elongated first element does not form a loop; and whereby the elongated element provides weight and air resistance during the rotation of the elongated first element.

Additional objects and advantages of the invention will be set forth in the description that follows, and in part will be obvious from the description, or may be learned by practice of the invention. The objects and advantages of the invention may be realized and obtained by means of instrumentalities and combinations particularly pointed out in the append claims.

BRIEF DESCRIPTION OF THE DRAWINGS

The features and advantages of an exercise device according to the present invention will be more clearly understood from the following description taken in conjunction with the accompanying drawings in which like reference numerals designate similar or corresponding elements, regions and portions and in which:

FIG. 4B includes a second loop.

FIG. 4C shows the loop forming device comprised of a hoop 166.

DETAILED DESCRIPTION OF THE PREFERRED EMBODIMENTS

Overview of Four Configuration Options

Figure 1A:
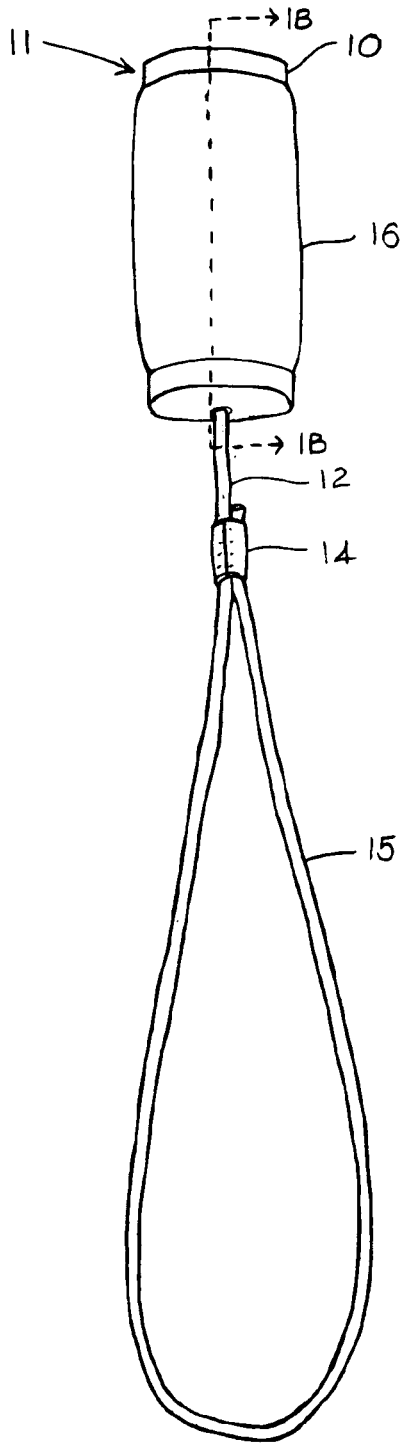
FIG. 1A shows an embodiment of the invention where a loop is formed in an elongated element using a loop forming means comprised of a cord coupler 14.

In general, the embodiments of the invention are exercising devices preferably for simulating jumping rope.

The embodiments of the invention can generally be grouped into four general configuration options as shown in FIGS. 9A, 9B, 9C and 9D (or FIGS. 1A, 4A, 6A and 8B). The first three configuration options (See FIGS. 9A, 9B, and 9C) have elongated elements that comprise loops. In the fourth configuration option (FIG. 9D) the elongated element does not have a loop.

Common to the three configuration options (and their embodiments) having loops (e.g., FIGS. 9A, 9B, and 9C) are the following. The device is comprised of two units. During use, each unit is held in a hand of a user. The user rotates the units to swing an elongated element. The units are comprised of: (1) a handle, (2) an elongated first element attached to the handle, and (3) the elongated element has at least a first loop.

In the first configuration option, (e.g., FIG. 9A) the loop forming device (e.g., 404) is located outside of the handle (400).

In the second configuration option, (e.g., FIG. 9B) the loop forming device (e.g., 404) is outside the handle 400 and the elongated element is preferably comprised of a first cord 412 and a loop 414. The first cord 412 is attached to the loop 414 (or second cord).

In the third configuration option, (e.g., FIG. 9C), the loop forming device 404 is inside the handle 400.

In the fourth configuration option (See e.g., FIG. 9D), the jump rope simulator does not have loops. The units are each comprised of: a handle, and an elongated first element attached to the handle. FIG. 8B shows the elongated first element comprised of a first cord 308 attached to the handle 10 and a soft flexible element 310 surrounding a portion of the first cord.

Figure 9D:
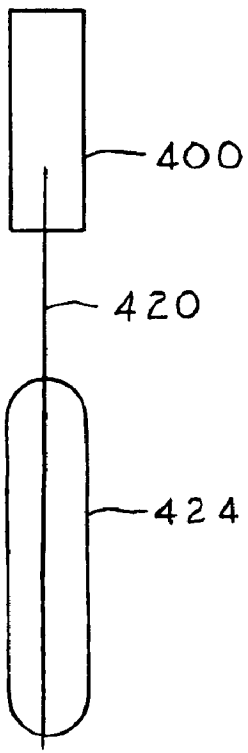
FIG. 9D shows a general view of the fourth configuration option of the invention without a loop.
Figure 9C:
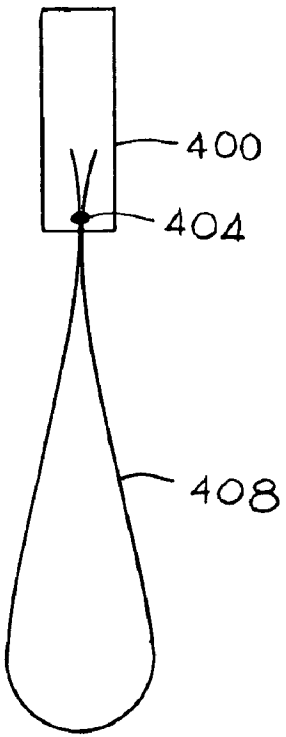
FIG. 9C shows a general view of the third configuration option of the invention where the loop forming device is inside the handle and the elongated element forms a loop.
Figure 9B:
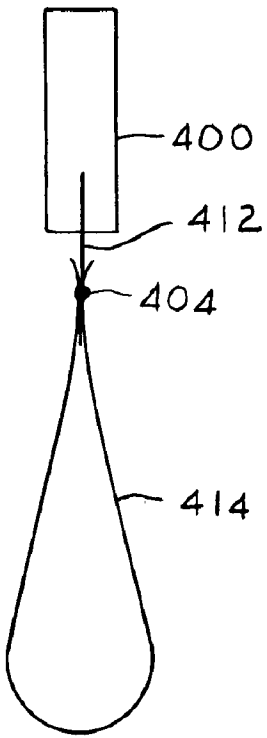
FIG. 9B shows a general view of the second configuration option of the invention where the loop forming device is located outside of the handle and the elongated element is comprised of a first cord 412 attached to the loop (or second cord) 414.
Figure 9A:
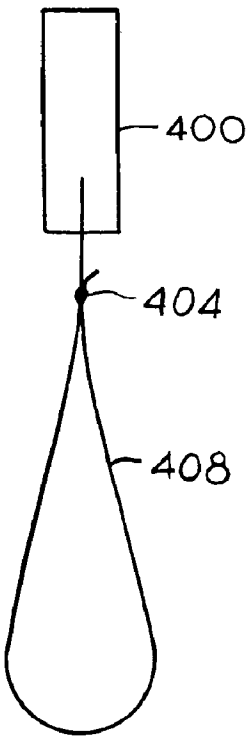
FIG. 9A shows a general view of the first configuration option of the invention where the loop forming device is located outside of the handle and the first elongated element 408 forms a loop.

FIG. 9A shows a general view of the first configuration option where the loop forming device 404 is located outside of the handle 400 and the loop is comprise of a first element 408. FIGS. 1A, 1F, 1G, 1H, 2A, 2B, 2C, 2D, 2E, 2F, 3A, 3B, 3C, 3D, and 6D show embodiments of the first configuration option, where the loop forming device (e.g., 14) is located outside of the handle.

FIG. 9B shows a general view of the second configuration option where the loop forming device 404 is located outside of the handle 400 and the elongated element is comprised of a first cord 412 attached to the loop 414 (or second cord). FIGS. 4A, 4B, 4C, 5A, 5B and 5C show embodiments of the second configuration option where the loop forming device (e.g., 144 146 148) is outside the handle and the elongated element is comprised of a first cord 140, a loop 142 and a loop forming device. The first cord is attached to the loop 142 (or second cord) using a loop forming device (e.g., means).

FIG. 9C shows a general view of the third configuration option where the loop forming device 404 is inside the handle 400 and the elongated element 408 forms a loop. FIGS. 6A, 7A, 7B, 7C, and 7D show embodiments of the third configuration option where the loop forming device is inside the handle (10).

Figure 8A:
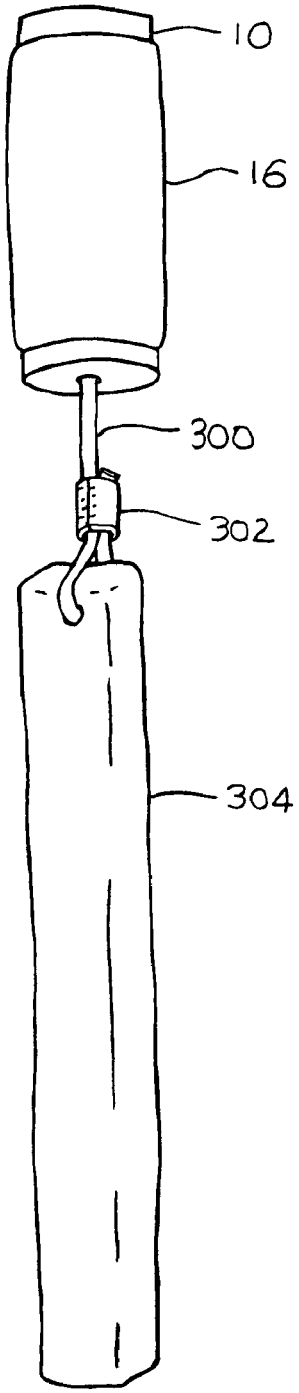
FIG. 8A shows an embodiment where the elongated first element is comprised of a first cord 300 attached to the handle 10 and a soft flexible element 304 attached to the first cord.
Figure 8B:
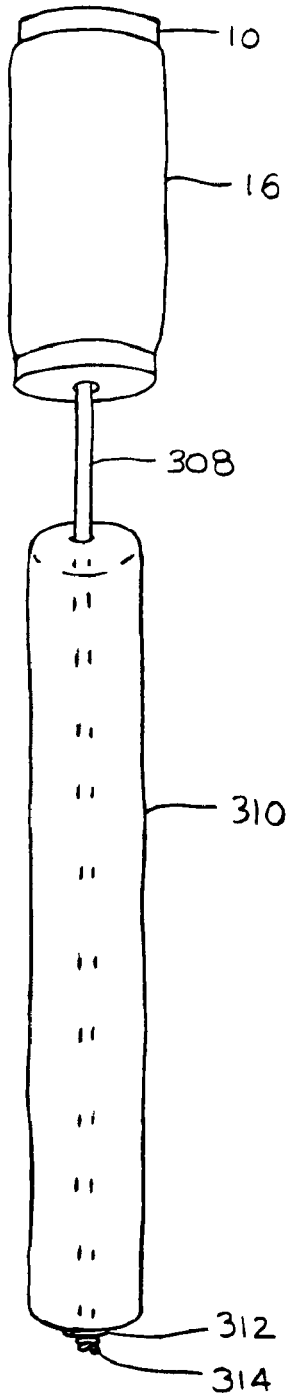
FIG. 8B shows an embodiment where the elongated first element is comprised a first cord 308 attached to the handle 10 and a soft flexible element 310 surrounding a portion of the first cord 308.
Figure 8C:
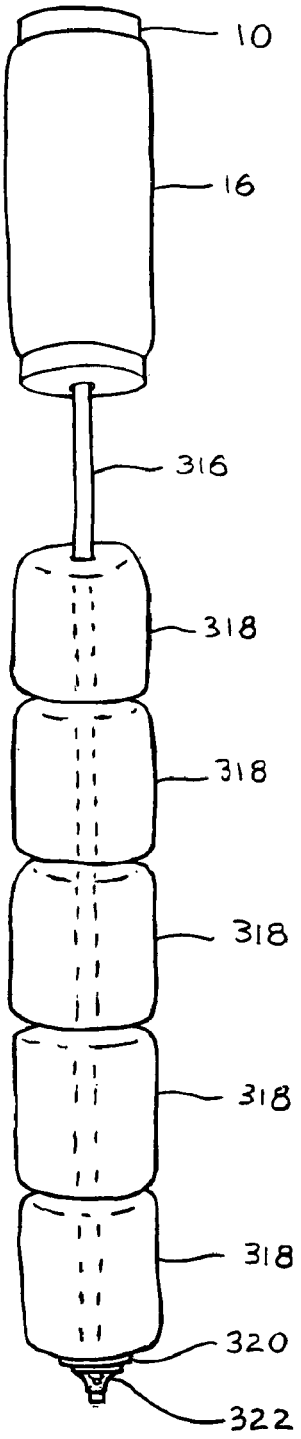
FIG. 8C shows an embodiment where the elongated first element is comprised of a first cord 316 attached to the handle 10 and a plurality of soft flexible elements 318 surround a portion of the first cord 318.
Figure 8D:
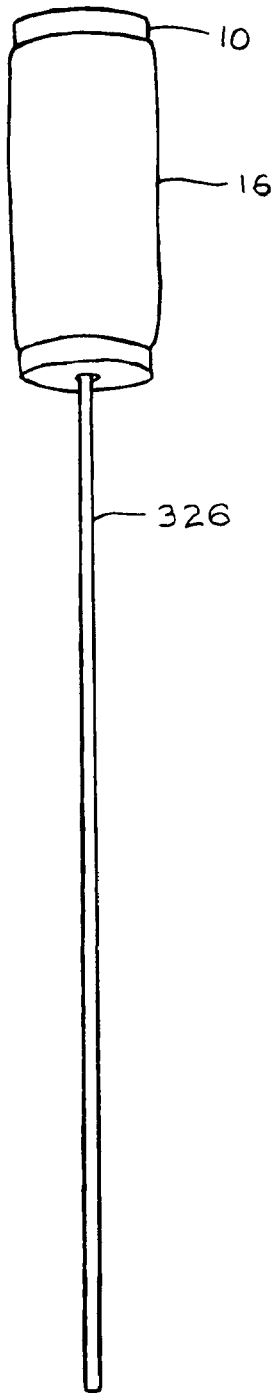
FIG. 8D shows an embodiment where the elongated first element is comprised of a elongated first element 326 attached to the handle 10. The elongated first element 326 is preferably a cord or rope.

FIG. 9D shows a general view of the fourth configuration option without a loop. FIG. 9D shows a handle 400 attached to an elongated element 420 424. An optional soft flexible element 424 surround portions of a cord 420. FIGS. 8A, 8B, 8C and 8D show embodiments of the fourth configuration option without loops.

First Configuration Option with the Loop Forming Device Outside the Handle

Referring to FIG. 1A, a preferred embodiment is shown where the loop forming device (e.g., 14) is located outside of the handle 10. The unit 11 is comprised of a handle 10, an elongated element (e.g., cord) 12 having a first loop 15, and a cord coupler 14. The cord coupler 14 is preferably metal. The embodiment shown in FIG. 1A also includes a loop forming device (e.g., 14) for forming a loop 15. The loop is preferably formed from a portion of the elongated first element 12.

Handles

In a preferred use, the units are designed to be held in the hands of a user in the same fashion as holding the handles of a jump rope. The user then rotates their hands and twirls the units in a similar fashion as a traditional jump rope. In closer detail, the handle 10 of each unit has opposite first and second ends. Ideally, the handle 10 is contoured to comfortably fit a hand of a user. In this ideal embodiment, the handle 10 preferably has a resiliently compressible outer layer therearound. Ideally, the outer layer 16 of the handle 10 comprises a resiliently compressible foamed rubber.

The handle is preferably cylindrically shaped with a hole in a bottom end where the cord can pass through.

Referring to FIG. 1A, the elongated element (e.g., cord) is attached to the handle 10. The elongated element can be attached to the handle by any suitable means or structure. For example, by a link or fastener or by passing the elongated element through an opening in the handle 10. The elongated element (e.g., cord) 12 is preferably rotatably attached to the handle 10. The cord 12 is preferably attached to the handle by a handle attaching device.

Elongated Element

The elongated element can be a cord, rope, line, twine, or any other similar object or combination of objects or cords. The elongated element could comprise a cord or several cords. The elongated element could be joined with other elements (such as loop forming devices, intermediate pieces or clips, connectors, rings, other cords or elongated elements, etc.). The elongated element can have a loop. A cord can be made from a variety of materials, including rope, leather, synthetic or simulated leather, plastic or beaded roped (e.g., a thin inner nylon rope with outer casing made of plastic beads). The cord can be several individual cords joined or connected together. Cords could be made from materials not commonly used in jump ropes today, including rubber cords or nylon straps. In addition, cord materials could be a combination of types, such as a beaded rope including a thin nylon rope with plastic outer casing beads combined with rubber outer casing portions. The rubber portion is preferrably positioned at the bottom of the loop and provides a safety function in case the loop hits the user or something else. Also, the rubber portion maintains a spread-open "U" shape at the end of the loop which is visually appealing and which provides increased safety by keeping the loop bottom spread open and thus spreading the impact if the device hits someone.

Loop Forming Devices

FIG. 1A shows the first loop formed by attaching a first section of the cord 12 to a second section of the cord. The cord can be attached back to itself using a cord coupling device or loop forming device. For example, FIG. 1A shows a cord coupler 14 which is preferably a metal piece that is crimped or stamped to hold multiple cord portions together. Other loop forming devices or cord attachment devices can include spring shaped metal couplers, or wire rings (e.g., wire wrapped around the cord portions), tape, or knots.

The cord can be attached back onto itself directly or indirectly. Directly can mean that that cord is in contact with another section of the cord. Indirectly can mean that the cord is joined to an intermediate piece (or pieces) and is joined back to a section of the cord. The cord can be indirectly joined to itself by a faster, cord coupler, loop and snaphook fastener, hook, annular piece (e.g., ring), hoop and loop fastener, cord knot, screw together fastener, or rope loop to rope loop connector.

Descriptions of Embodiments with the First Configuration Option

Figure 1B:
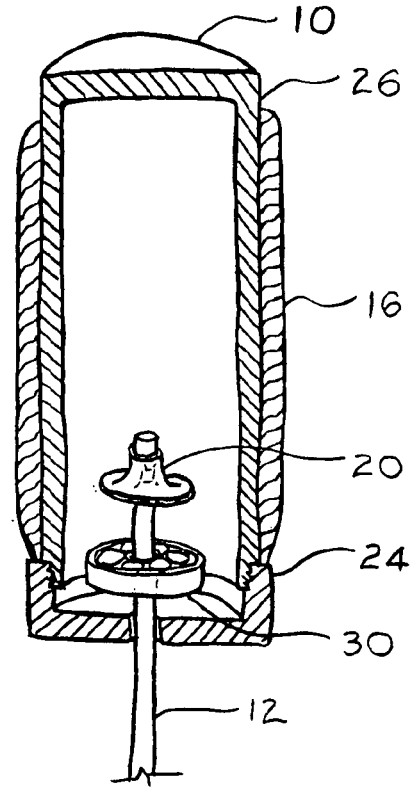
FIG. 1B shows a cross sectional view of a preferred embodiment of the handle along the axis 1B shown in FIG. 1A.

FIG. 1B shows a cross sectional view of a preferred embodiment of the handle 10. FIG. 1B shows the handle comprised of two pieces 24 26: a lower piece 24 having an opening through which the cord 12 passes; and a upper piece 26. The lower piece 24 can have an internal thread and the upper piece 26 can have an external thread that can be screwed together. Preferably the upper piece 26 has a closed top. The handle can have an outer grip material 16 such as foam rubber. The cord 12 is preferably attached to the handle 24 by a lipped or flanged metal handle attaching device 20 and optional ball bearings 30.

Figure 1C:
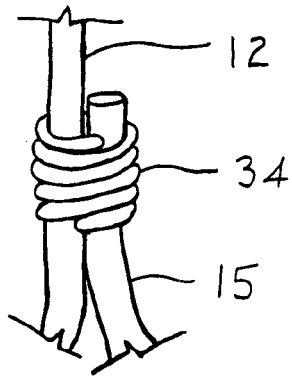
FIG. 1C shows another embodiment of the cord coupling device comprised of a spring shaped metal coupler 34.

FIG. 1C shows another embodiment of the cord coupling device (e.g., loop forming device) comprised of a spring shaped metal coupler 34.

Figure 1D:
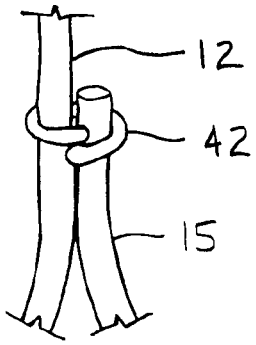
FIG. 1D shows another embodiment of the cord coupling device comprised of a ring shaped metal coupler 42.

FIG. 1D shows another embodiment of the cord coupling device (e.g., loop forming device) comprised of a ring shaped metal coupler 42.

Figure 1E:
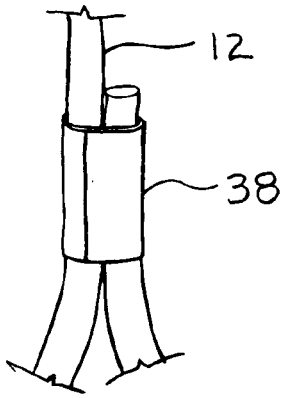
FIG. 1E shows another embodiment of the cord coupling device comprised of a tape coupler 38.

FIG. 1E shows another embodiment of the cord coupling device comprised of a tape coupler 38.

Figure 1F:
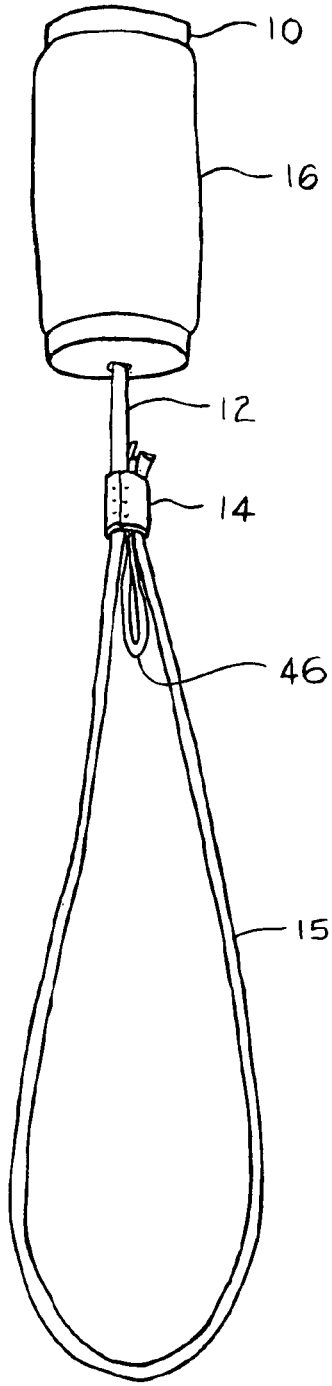
FIG. 1F shows another embodiment of the unit and cord coupling device where a second smaller cord 46 forms a hoop and is fastened with a metal cord coupler to the first main cord 12.

FIG. 1F shows another embodiment of the cord coupling device where a second shorter cord forms a hoop 46 (e.g., length of cord that is connected back onto itself with an inner opening) and is fastened with metal coupler 14 that creates the loop (e.g., 15) in the first main cord 12. The second small cord hoop can be used to attach additional loops or cords to the first main cord 12. (See e.g., FIG. 1H). The attachment of a second loop to the hoop 46 is an example of indirectly attaching a second loop to the first loop 15. Hoop is intended to be used for attaching other pieces and not meant to be used as a "loop" nor designed with the length and weight to be a "loop" to simulate a jump rope. The hoop 46 is preferably between 0.5 inches and 3 inches long.

Figure 1G:
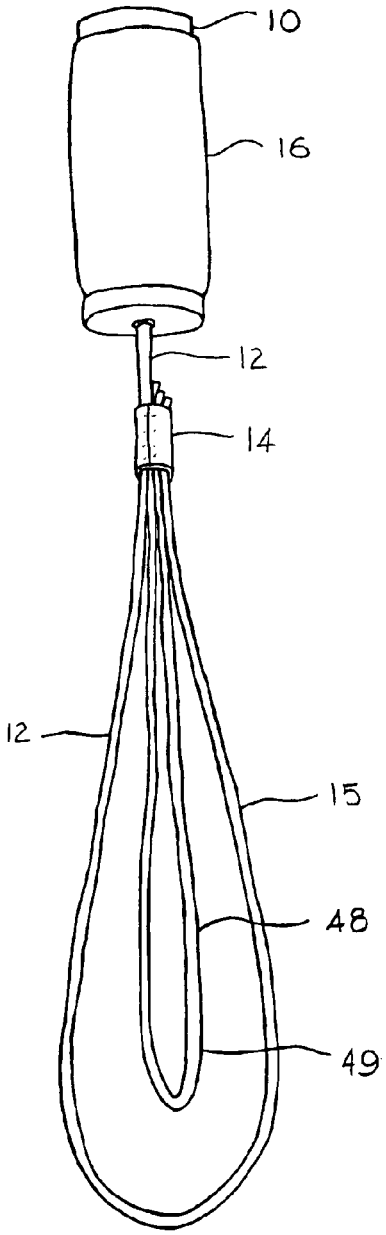
FIG. 1G shows another embodiment of the invention where the elongated element is comprised of two loops.

FIG. 1G shows another embodiment of the invention where the elongated element is comprised of two loops: the first loop 15 and the second loop 49. FIG. 1G shows an embodiment where a second loop 49 is attached to the first cord 12 by a cord coupling device (e.g. coupler 14). The second loop 49 is not meant to be a hoop to attach other devices.

In this embodiment two separate cords 12 48 form the two loops 15 49. However, one cord could be used to form the two loops by folding one cord into two loops. A cord attachment device (e.g. loop forming device or coupler 14) is used to attach the main cord 15 to the second loop 49.

Figure 1H:
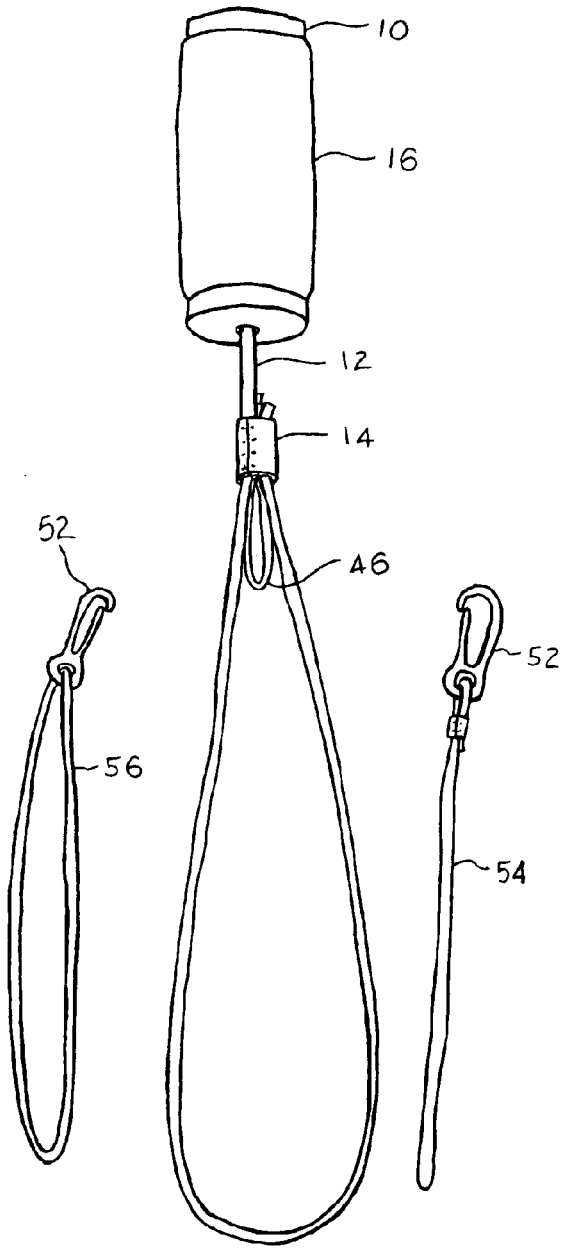
FIG. 1H shows another embodiment of the invention where additional loops or elongated elements can be attached to the device.

FIG. 1H shows another embodiment of the invention where a second smaller cord forms a hoop 46 and is fastened with a metal coupler 14 to the first main cord 12. The second small cord hoop 46 can be used to attach additional loops 56 or cord members 54 to the first or main cord 12. The additional loops 56 or cord members without loops can be connected using snaphooks 52.

Figure 2A:
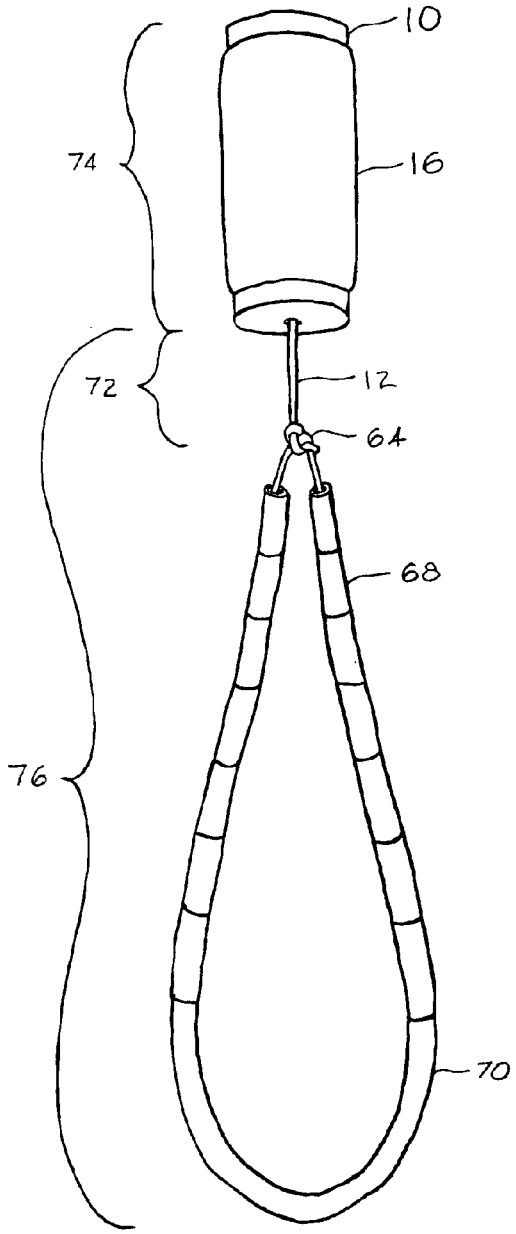
FIG. 2A shows another embodiment where the first loop is formed by attaching a first section of cord 12 to a second section of the cord.

FIG. 2A shows the first loop formed by attaching a first section of cord 12 to a second section of the cord. The cord can be attached back to itself using a cord coupling device or loop forming device. For example, FIG. 2A shows a knot 64, preferably a bowline knot, to hold multiple cord sections together. Other loop forming devices or cord attachment devices can include metal cord couplers, spring shaped couplers, other knots, or wire rings (e.g., wire wrapped around the cord) or tape.

The distance 72 between the attachment device (e.g., loop forming device) 64 and the handle is preferably less than 2.5 inches and is more preferably between 1 and 2 inches.

The length 74 of the handle is preferably between 3 and 5 inches.

The distance 76 from the bottom of the handle and the furthest point of the elongated element preferably is less than 24 inches and preferably between 10 to 24 inches and is more preferably between 16 to 20 inches.

The cord 12 is preferably 118 inch nylon rope with an outer casing of plastic beads 68 and a rubber portion 70 at the bottom of the loop.

Figure 2B:
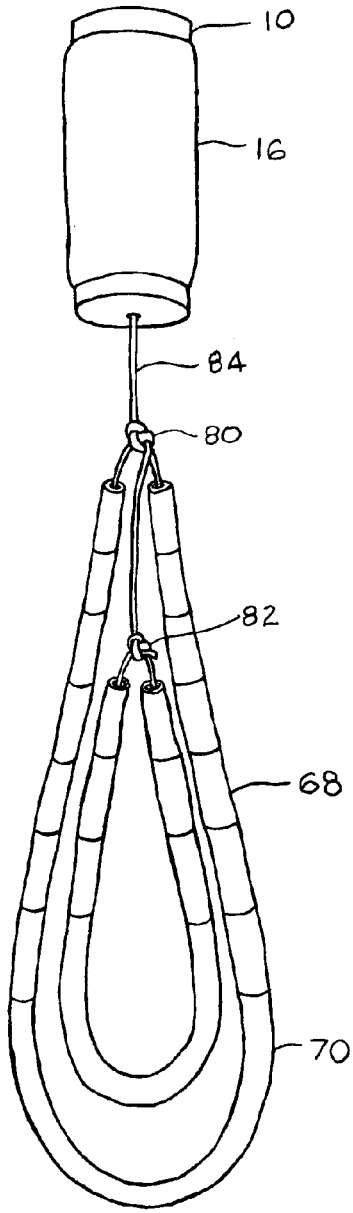
FIG. 2B shows another embodiment where two loop forming means (e.g., attachment devices) 80 82 are used to form two loops in the elongated element 84.

FIG. 2B shows another embodiment of the invention where two attachment devices (loop forming devices) 80 82 are used to form two loops in the elongated element 84. The elongated element can comprise one or more cords. Here the two attachment devices 80 82 are knots, but are not limited to knots.

Figure 2C:
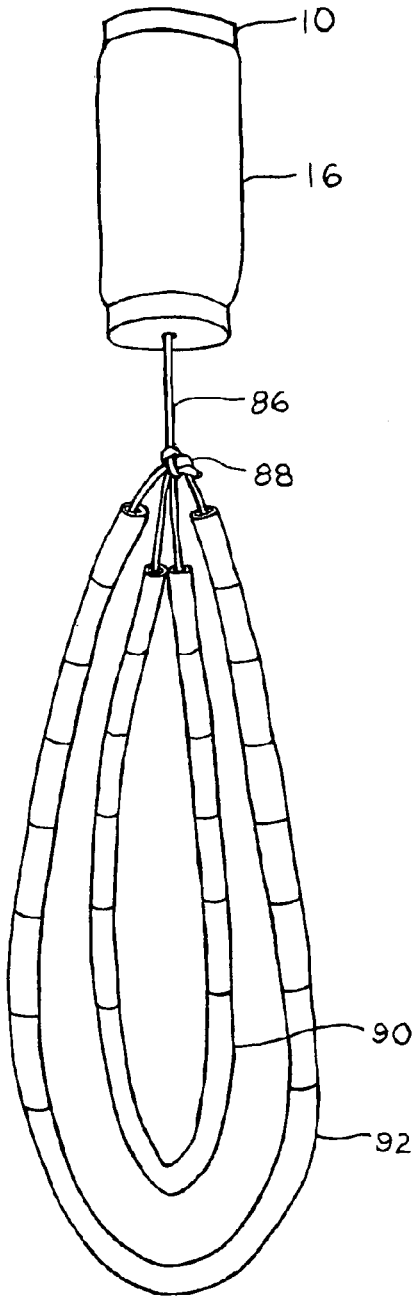
FIG. 2C shows another embodiment where one loop forming device (e.g., a knot) 88 is used to form two loops in the elongated element 86.

FIG. 2C shows another embodiment where one loop forming device (e.g., knot) 88 is used to form two loops 90 92. The elongated element 88 can be comprised of one or more cords.

Figure 2D:
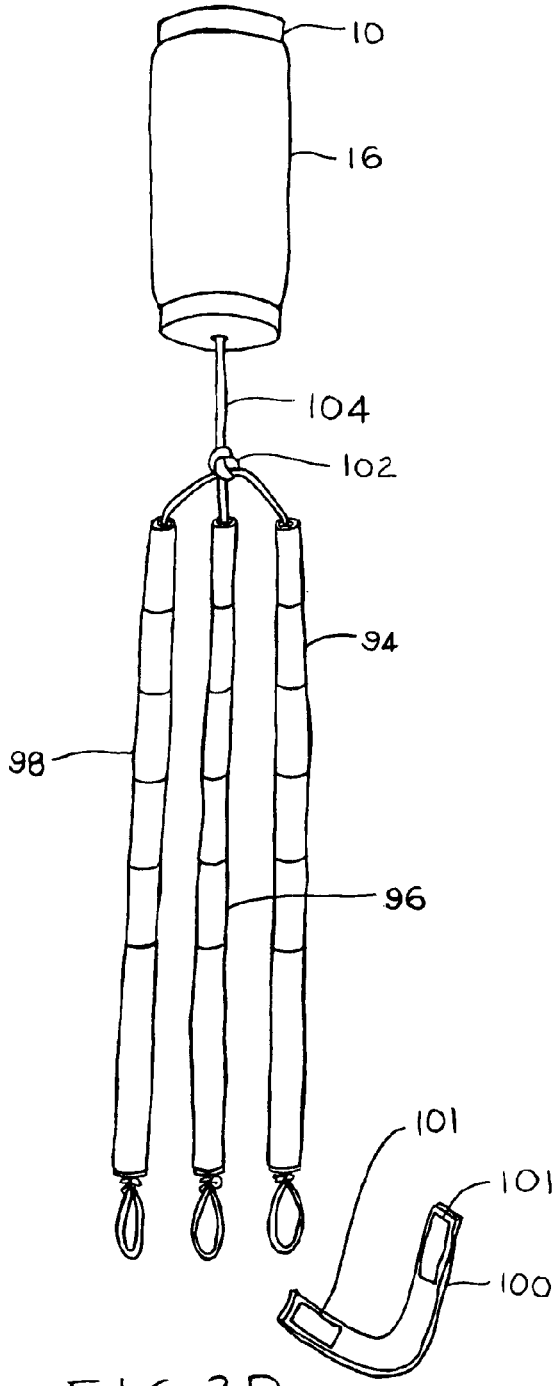
FIG. 2D shows another embodiment where the unit is comprised of three extended elements 94 96 98.

FIG. 2D shows another embodiment where the unit is comprised of three extended elements 94 96 98. One loop forming device 102 is used. In a preferred embodiment, two cords are used, elements 104 and 96 comprise one cord, and elements 98 and 94 comprise a second cord. The ends of the elements 94 96 98 can be joined together using a joining device 100. The joining device 100 can be a hook and loop faster 101, knot or other device(s) or detachable device(s).

Figure 2E:
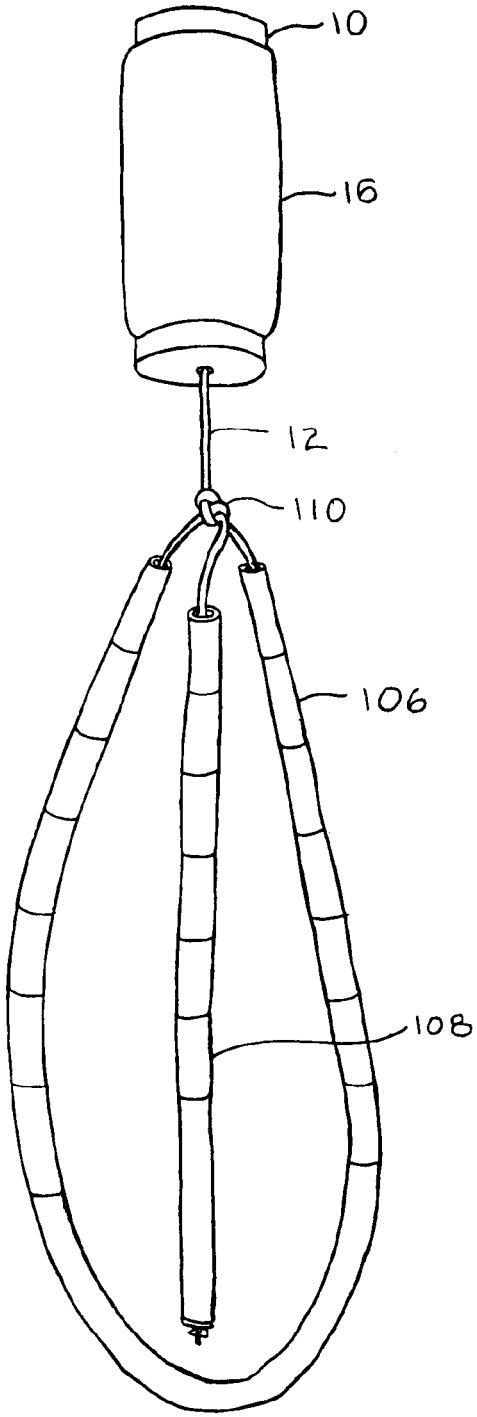
FIG. 2E shows an embodiment where the device has a loop and an extended element.

FIG. 2E shows an embodiment where the device has a loop 106 and an extended element (e.g., non-looped extended element) 108. The looping device 110 forms both the loop 106 and the extended element (e.g., non-looped extended element) 108.

Figure 2F:
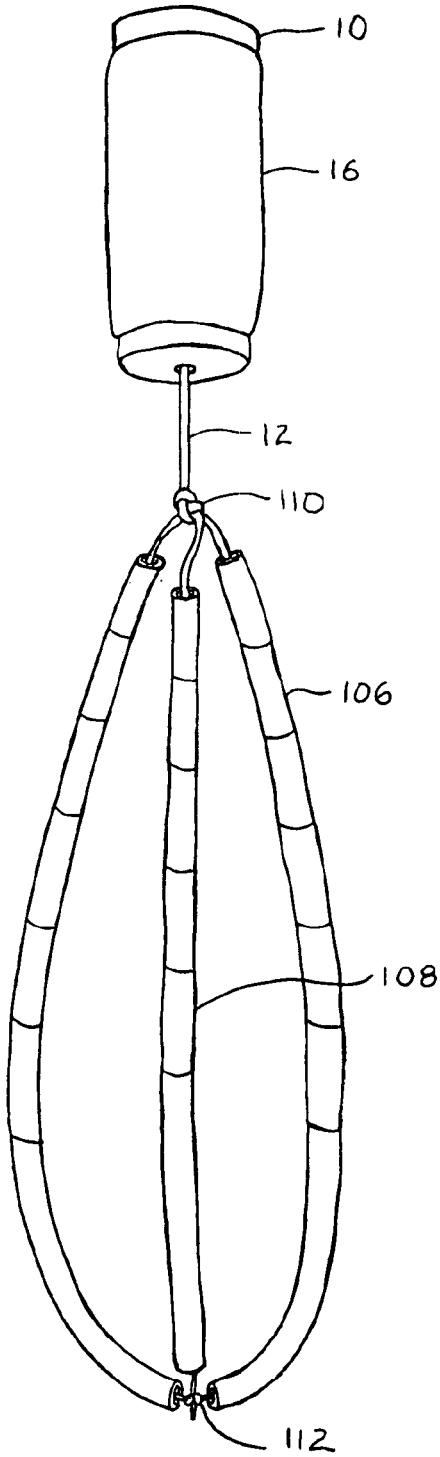
FIG. 2F shows an embodiment where a loop 106 is joined to an extended element 108 by a second loop forming device 112 (e.g., a knot).

FIG. 2F shows an embodiment where a loop 106 is joined to an extended element 108 by a second loop forming device 112 (or attachment device, e.g., a knot). This embodiment effectively has two loops formed from three extended elements or forms one loop attached to an extended element. The second loop forming device 112 can optionally be uncoupled to let one or more of the cords be unattached.

Figure 3A:
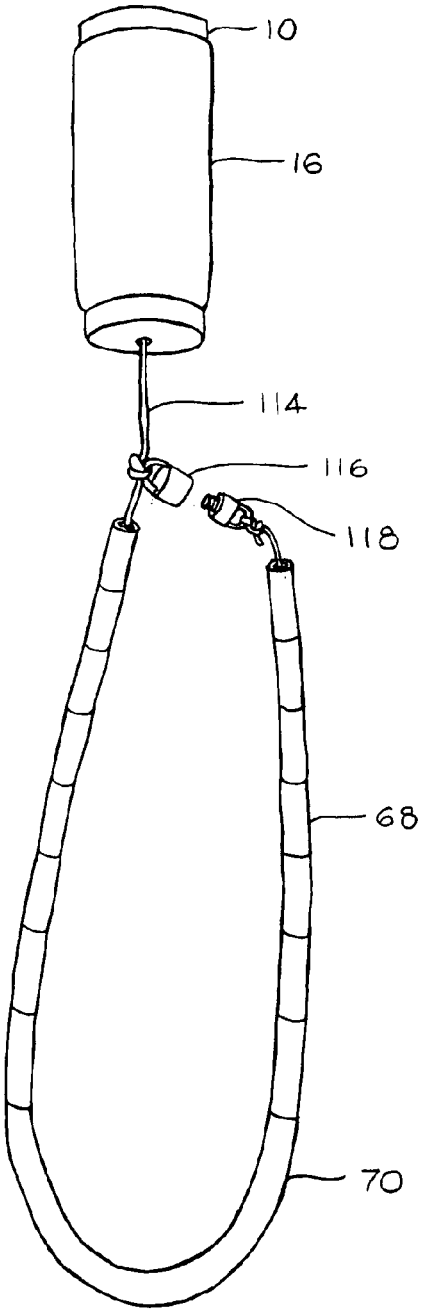
FIG. 3A shows another embodiment of the invention where the loop forming device 116 118 can be separated so that one section of the elongated element 114 is not attached to another section of the elongated element 114.

FIG. 3A shows another embodiment of the invention where the loop forming device 116 118 can be separated so that one section of the elongated element 114 is (detachable) not attached or connected to another section of the elongated element 114. The loop forming device 116 118 can be unattached or unconnected.

The cord (e.g., 114) is preferably ⅛ inch nylon rope with an outer casing of plastic beads 68 and a rubber portion 70 at the bottom of the loop.

Figure 3B:
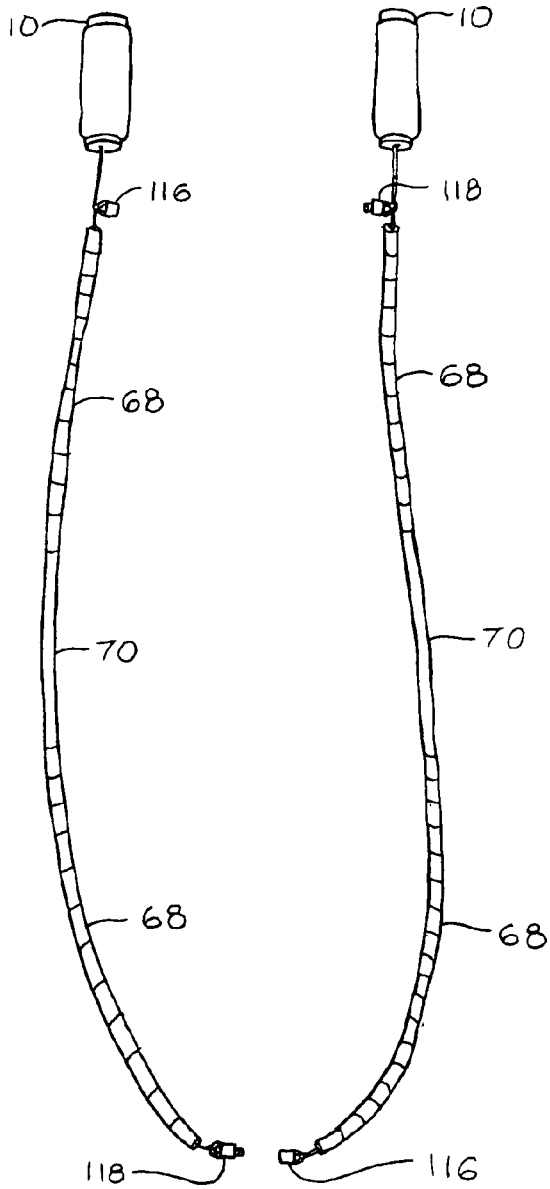
FIG. 3B is another embodiment where the two units can be joined together to form a conventional jump rope.

FIG. 3B is another embodiment where the two units can be joined together to form a conventional jump rope. FIG. 3B shows the loop forming devices 116 118 are in opposite positions on the two units and can be joined together or connected together to form a traditional jump rope. The first part 116 of the device can be connected (or/and unconnected) (e.g., detachable or removably attached) to the compatible second part 118 of the loop forming devices. For example, the first part 116 can have internal threads and the second part 118 can have external threads that screw together. The first part 116 and second part 118 can be connected to each other by any suitable method. The first part 116 and second part 118 can be any device that can be connected (or detachably joined), such as snaphooks and loops, hook and loop fasteners, fasteners, screw units, male-female fittings, etc.

Figure 3C:
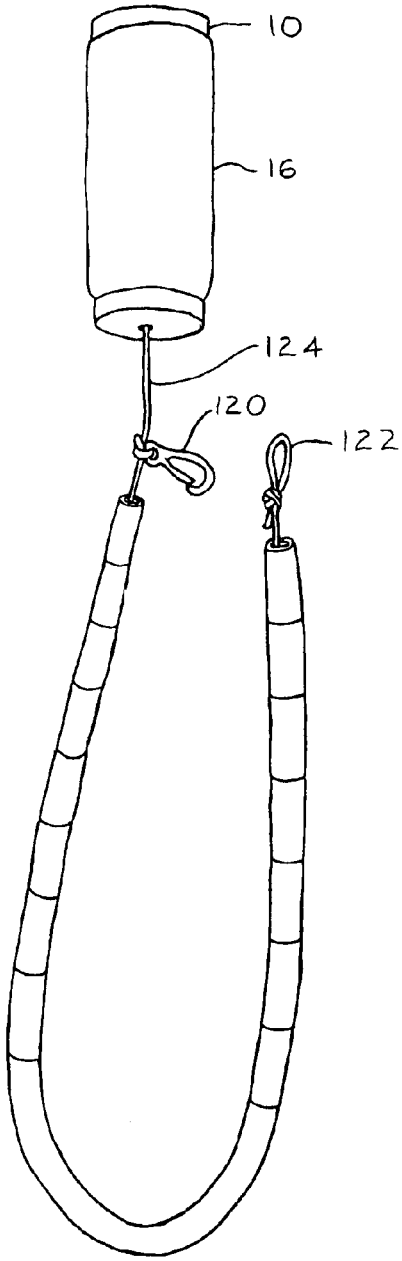
FIG. 3C shows another embodiment where the detachable loop forming device 120 122 comprises a snap hook 120 and a closed loop 122 of cord.

FIG. 3C shows another embodiment where the detachable (e.g., removably attached) loop forming device 120 122 comprises a snaphook 120 and a closed loop 122 of cord. The cord 124 is attached to the handle 10.

Figure 3D:
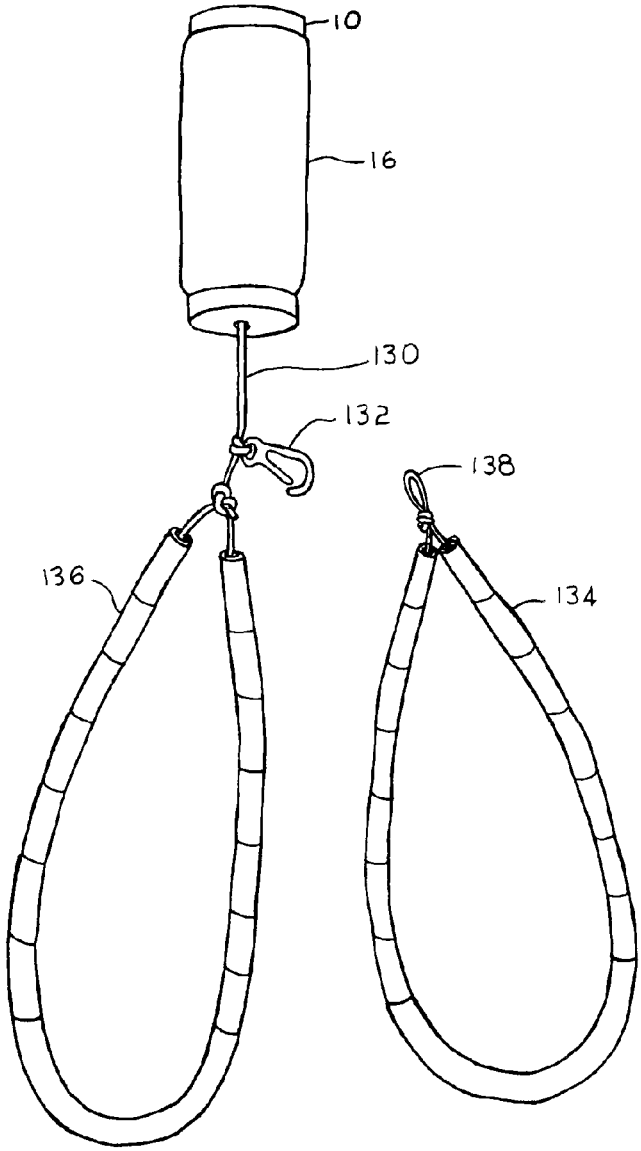
FIG. 3D shows another embodiment where a second loop 134 is attached to the elongated first element 130.

FIG. 3D shows another embodiment where a second loop 134 is attached to the elongated first element 130. The elongated first element 130 and second loop 134 are attached by a connecting device. The elongated first element 130 can have a first loop 136. FIG. 3D shows a connection device (e.g., connector) comprised of a snaphook 132 and a closed loop 138 on the second loop 134 The connection device has the ability to be connected or unconnected. Other connection devices (e.g., detachable) can be used, such as hook and loop fasteners, hoops and boltsnaps, and knots.

Second Configuration Option—Embodiments with More than One Cord

FIG. 9B shows a general view of the second configuration option where the loop forming device 404 is located outside of the handle 400 and the elongated element is comprised of a first cord 412 attached to the loop 414 (or second cord) by the loop forming device 404.

FIG. 9B shows a unit comprising a handle 400 for gripping the unit; a first cord 412 having a first and a second end; the first end of cord rotatably attached to the handle 400; and an attachment means 404 for joining the first cord 412 to a first loop 414. The ends of the cords or elongated elements can be portions of the cord near or towards the most distant points of the cord and are not limited to the tips at the end of the cords or elongated elements.

FIGS. 4A, 4B, 4C, 5A, 5B and 5C show embodiments of the second configuration option where the loop forming device (e.g., 144 146 148) is outside the handle and the elongated element is comprised of a first cord 140, a loop 142 and a loop forming device. The first cord is attached to the loop 142 (or second cord) using a loop forming device (e.g., means).

Figure 4A:
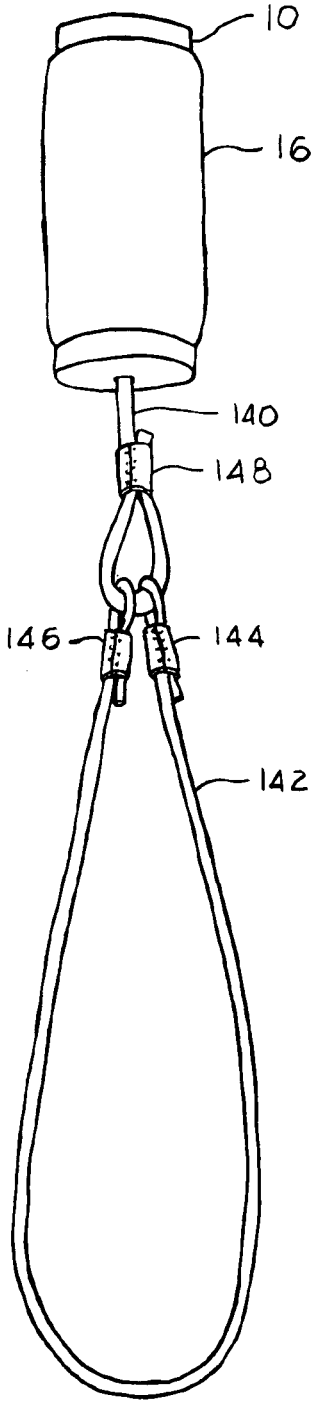
FIG. 4A shows another embodiment where the elongated element is comprised of two or more cords.

FIG. 4A shows an embodiment where the elongated element is comprised of two or more cords. The loop forming device is comprised of cord couplers 144 146, 148. The cord 140 can be called a trunk cord. The unit has a loop 142 formed of a second cord. Additional loops can be attached to the trunk cord 140 using any suitable means, such as a hoop.

Figure 4B:
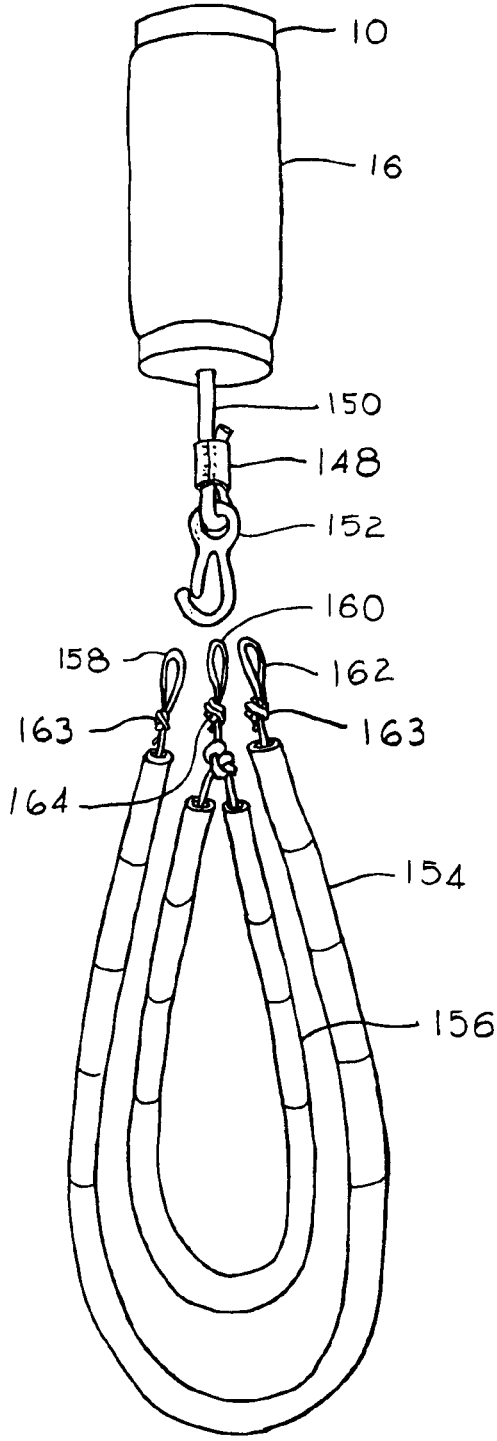
FIG. 4B shows another embodiment where the loop forming device is comprised of a snap hook 152 and hoops 158 162.

FIG. 4B shows another embodiment where the loop forming device is comprised of a snaphook 152 and hoops 158 160 162. Knots 163 and 164 form the hoops 158 160 163 in the cords. FIG. 4B shows a first loop 154 and a second loop 156 attached to a first (trunk) cord 150. The handle 10 is attached to the trunk cord 150. The loop 154 is preferably ⅛ inch nylon rope with an outer casing of plastic beads and a rubber portion at the bottom of the loop. The second loop 156 is preferably ⅛ inch nylon rope with an outer casing of plastic beads.

Figure 4C:
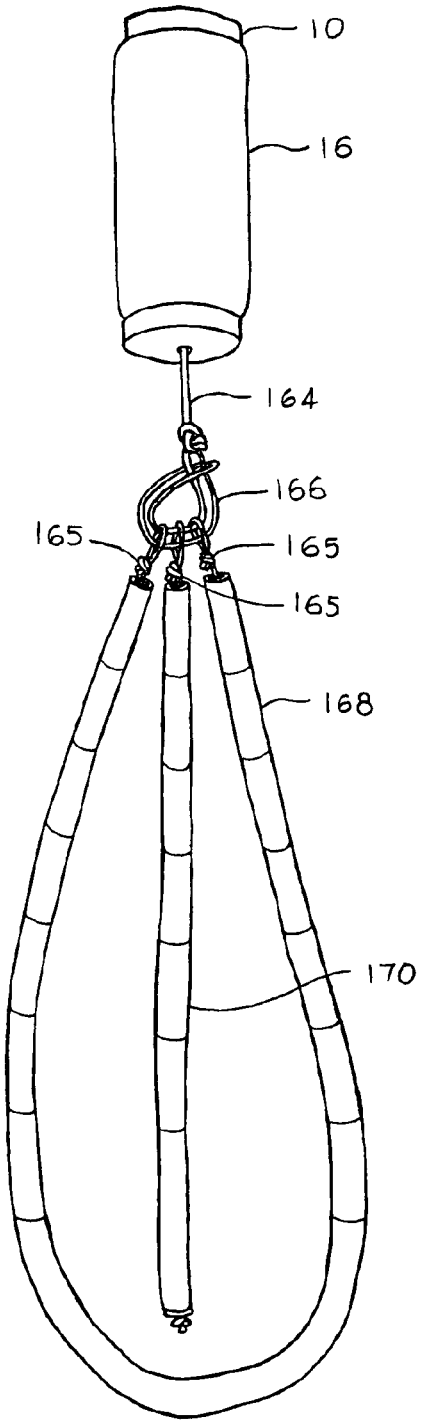
FIG. 4C shows another embodiment of the invention.

FIG. 4C shows another embodiment of the invention. FIG. 4C shows the loop forming device comprised of a detachable hoop 166. A first loop 168 and an optional second elongated element 170 are attached to the first cord 164. Knots 165 form hoops on the ends of the cords. Any loop forming devices could be used to form the loop and attach to or connect to other loops or elements. The loop 168 is preferably ⅛ inch nylon rope with an outer casing of plastic beads and a rubber portion at the bottom of the loop. The optional second elongated element 170 is preferably ⅛ inch nylon rope with an outer casing of plastic beads and a rubber portion at the bottom.

Figure 5A:
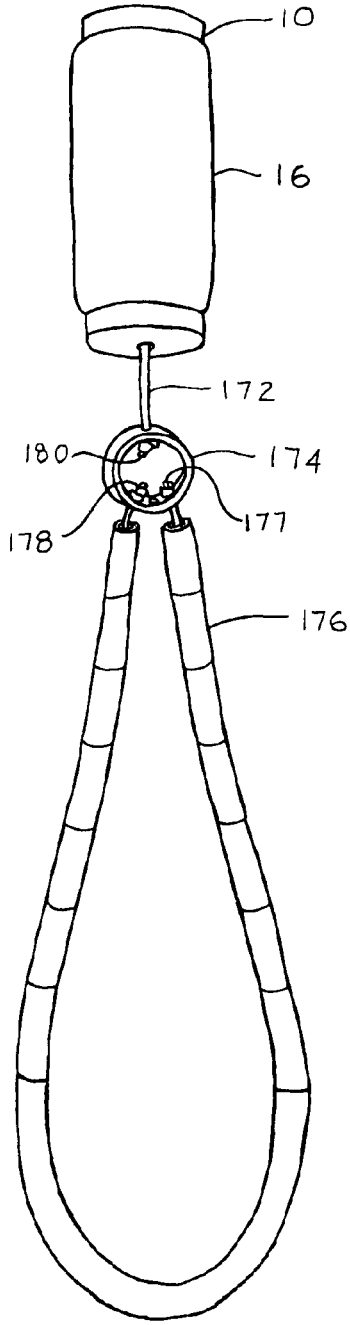
FIG. 5A shows an embodiment of the invention where the loop forming device is comprised of an annular element 174.

FIG. 5A shows an embodiment of the invention where the loop forming device is comprised of an annular element 174. The annular shaped piece 174 has holes that accept and attach to a portion of the elongated element. The elongated element can be comprised of one of more cords FIG. 5A shows a first cord 172 and second cord 176 with first and second ends 177 178 that can form a loop. The second cord ends can have knots to attach to the annular element 174.

Figure 5B:
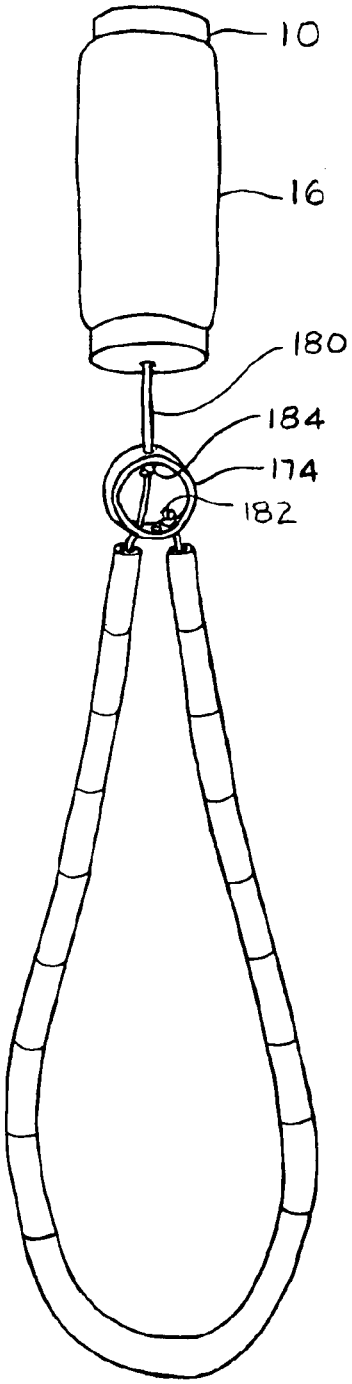
FIG. 5B shows an embodiment of the invention where the loop forming device is comprised of an annular element 174.

FIG. 5B shows an embodiment of the invention where the loop forming device is comprised of an annular element 174. The annular element 174 has holes that accept and attach to a portion of the elongated element. FIG. 5B shows the elongated first element comprised of one cord 180. The cord has knots 182 and 184 that attach the cord 180 to the annular element 174.

Figure 5C:
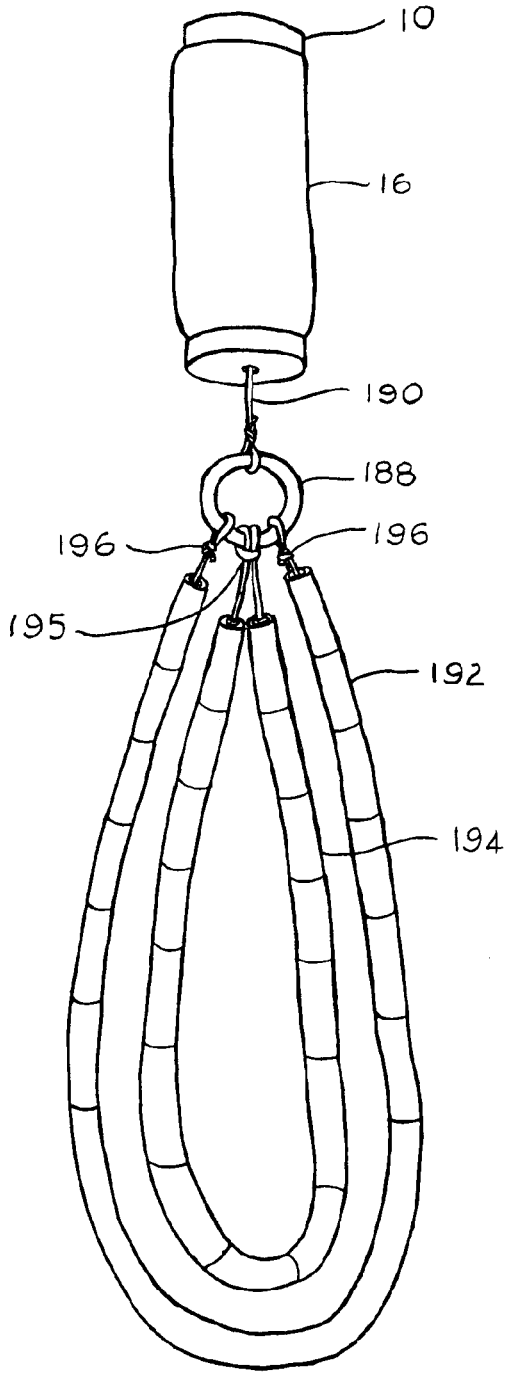
FIG. 5C shows an embodiment of the invention where the loop forming device is comprised of an annular element 188.

FIG. 5C shows an embodiment of the invention where the loop forming device is comprised of an annular element 188. FIG. 5C shows the elongated element comprised of three cords 190, 192 and 194. The trunk cord 190 is attached to the handle 10 and the ring 188 preferably using a knot 189. The first and second loops 192 194 are attached to the ring 188. The first loop 192 is attached to the ring 188 by knots 196. The second loop 194 is attached to the ring 188 by a detachable hoop 195. The first and second loops 192 194 can be attached to the ring 188 using any suitable connection device.

Figure 6A:
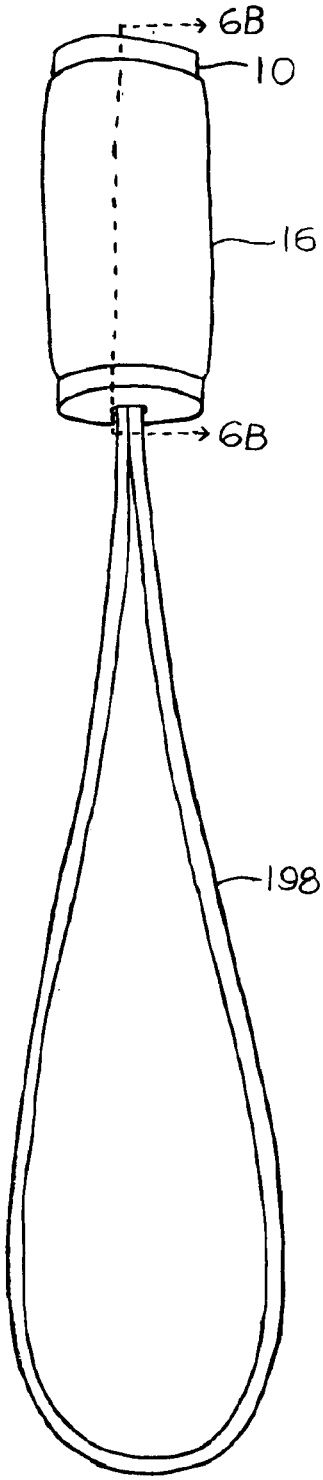
FIG. 6A shows an embodiment of the invention where the loop forming device is located inside the handle 10.

Third Configuration Option—Embodiments with Loop Forming Device Inside the Handle In a third configuration option (see e.g. FIGS. 9C and 6A), the loop forming device is inside the handle. FIGS. 6A, 6B, 6C, 7A, 7B, 7C, 7D show embodiments where the loop forming device is inside the handle (10). As shown in FIG. 6A, the loop forming device is inside the handle 10. Also see FIG. 6B for a cross sectional view of the handle and loop forming device in FIG. 6A. See FIG. 6C for another embodiment of the loop forming device in the handle. In these embodiments, each unit comprises: a handle 10 for gripping the unit; a first cord having a first and a second end; the first cord attached to the handle to form a first loop.

FIG. 6A shows an embodiment of the invention where the loop forming device is located inside the handle 10. FIG. 6A shows that two portions of the cord 198 are attached to the handle thereby forming a loop.

Figure 6B:
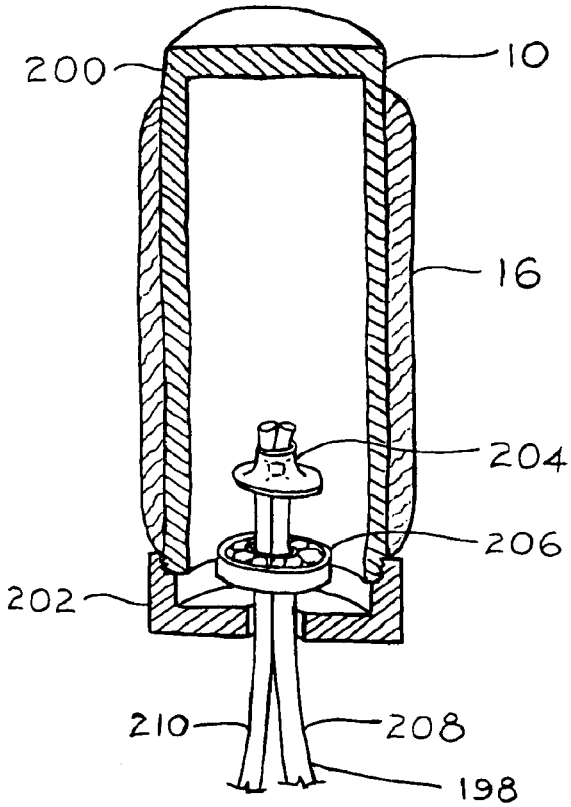
FIG. 6B shows a cross sectional view of a preferred embodiment of the handle shown along the axis 6B in FIG. 6A where the loop forming device is inside handle 10.

FIG. 6B shows a cross sectional view of that handle where the loop forming device is inside handle 10. FIG. 6B shows the loop forming device comprised of a cord coupler 204. The cord coupler is preferably comprised of lipped or flanged metal. The handle also has an optional ball bearing 206 or washer, not shown, around the two cord portions 210 and 208. A soft outer shell 16 such as foam rubber can cover portions of the handle 10. The handle 10 can be comprised of a first (upper) piece 200 that can have an external thread and a second (lower) piece 202 that can have an internal thread that can be screwed together.

Figure 6C:
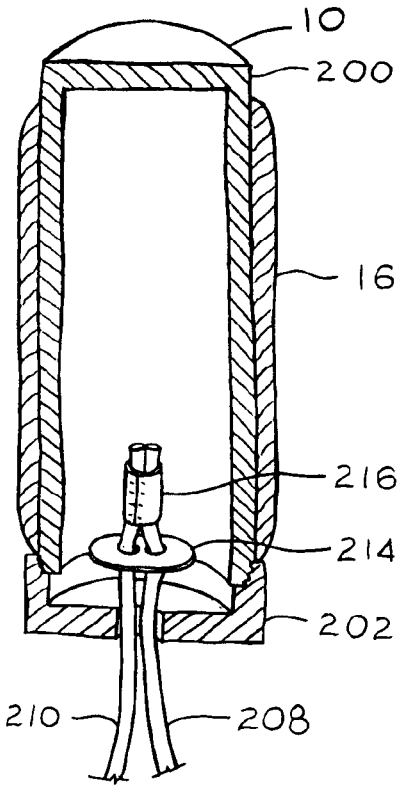
FIG. 6C shows a cross sectional view of the handle where a washer 214 has two holes through which two cord portions pass.

FIG. 6C shows another cross sectional view of the handle 10 (200 202) where a washer 214 has two holes through which two cord portions pass. The cord portions can be secured by a cord coupler 216 or any suitable device. The washer provides an unexpected superior connection that allows the cords to rotate and provides a superior simulation of rope jumping.

Figure 6D:
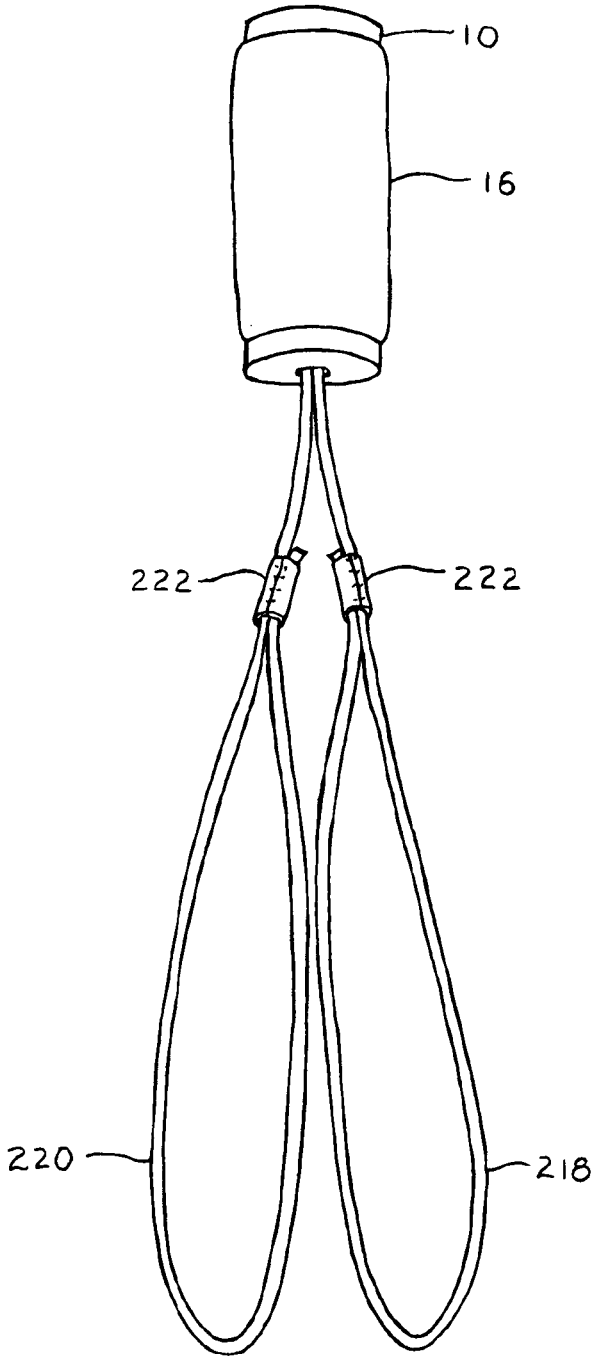
FIG. 6D shows another embodiment where two loops 218 220 are attached to the handle.

FIG. 6D shows another embodiment where two loops 218 220 are attached to the handle using attachment means shown in FIG. 5B or FIG. 5C. The loops could be formed from one or more cords. For example, loop 218 could be formed from one cord and loop 220 could be formed from another cord. The loops 220 218 could be formed by any suitable loop forming device. FIG. 6D shows metal cord couplers 222.

Figure 7A:
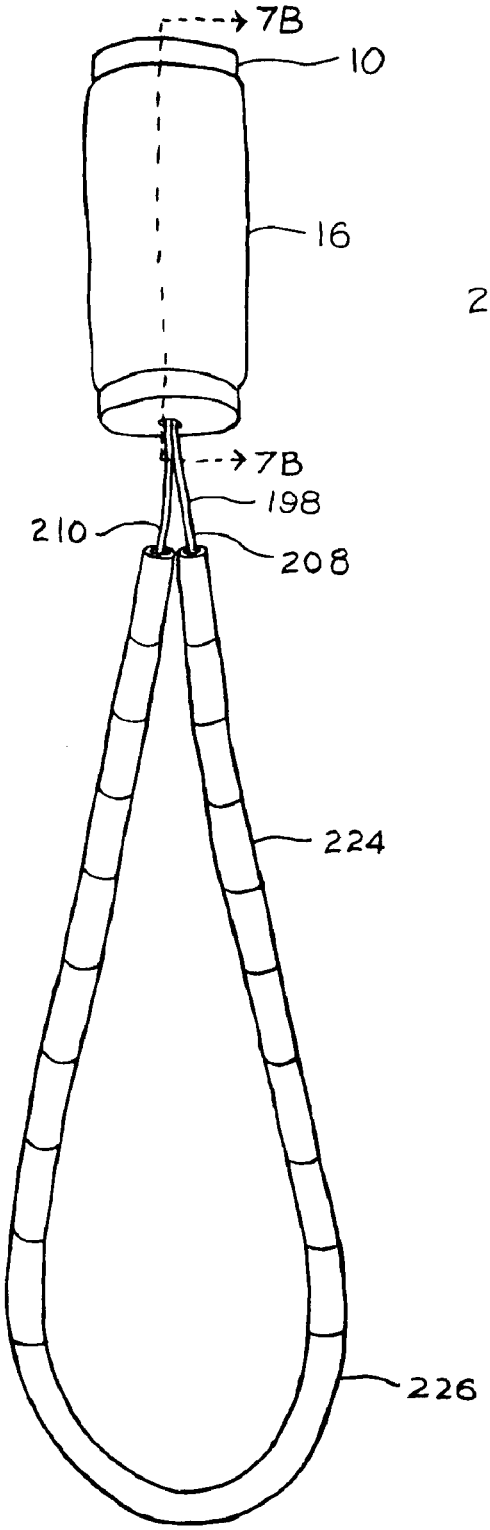
FIG. 7A shows an embodiment of the invention where the loop forming device is located inside the handle 10.

FIG. 7A shows yet another embodiment similar to that shown in FIG. 6A. FIG. 7A shows an important embodiment of the invention where the loop forming device is preferably located inside the handle 10. FIG. 7A shows that two portions 208 210 of the cord 198 are attached to the handle thereby forming a loop. In an alternative embodiment, the two cord portions could pass entirely through the handle 10 and be attached to the handle on the outside end of the handle.

FIG. 7A shows tubular elements 224 around a portion of the elongated element 198. In this embodiment, the elongated element 198 is preferably ⅛ inch nylon rope. The tubular elements 224 provide an outer casing. The tubular elements are preferably comprised of beads or plastic beads. The tubular elements 224 can provide weight or air resistance and protection to the user. Theses tubular elements allow the weight and wind resistance of the units to be adjusted. FIG. 7A shows a soft cushion element 226 covering a portion of the cord 198, preferably at the bottom of the loop. The soft cushion element 226 can be one piece or many pieces.

Figure 7B:
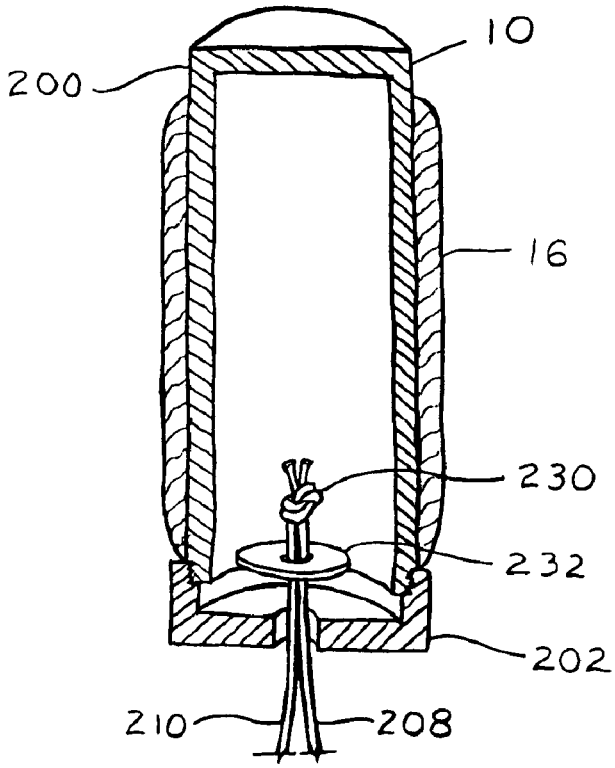
FIG. 7B shows a cross sectional view of a preferred embodiment of the handle along the axis 7B shown in FIG. 7A where the loop forming device is inside handle 10.

FIG. 7B shows a cross sectional view of that handle where the loop forming device is inside the handle 10. FIG. 7B shows the loop forming device comprised of a knot 230. The handle also has a washer 232 around the two cord portions 210 and 208. A soft outer shell 16 such as foam rubber can cover portions of the handle 10. The handle 10 can be comprised of first and second parts 200 202. The upper piece 200 can have external threads and the lower piece 202 can have internal threads that can be screwed together.

Figure 7C:
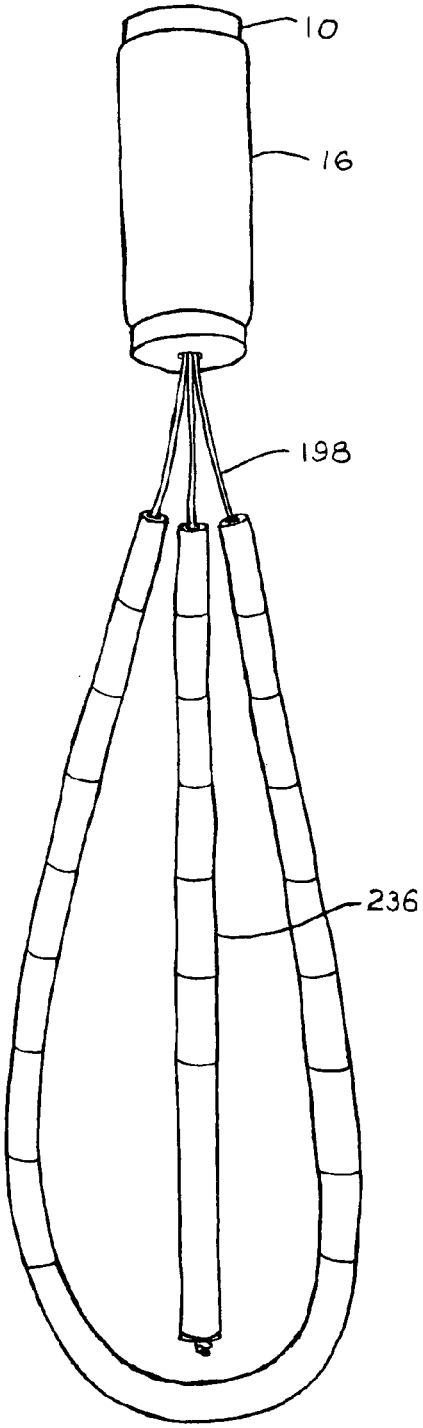
FIG. 7C shows another embodiment where a first loop 198 and a second elongated element 236 are attached or connect to the handle 10.

FIG. 7C shows another embodiment where a first loop 198 and a second elongated element 236 are attached or connect to the handle 10. The first loop 198 and a second elongated element 236 can for formed from one cord (e.g., the elongated first element 198). The end of the cord 236 can have a washer and knot to secure the cord to the handle. The cords can have outer casings of beads and/or rubber portions. As shown in FIG. 7C (and 7D) the first loop is formed by attaching a first portion of the elongated first element to a second portion of the elongated first element; a section of the first loop is on or inside a portion of the handle.

Figure 7D:
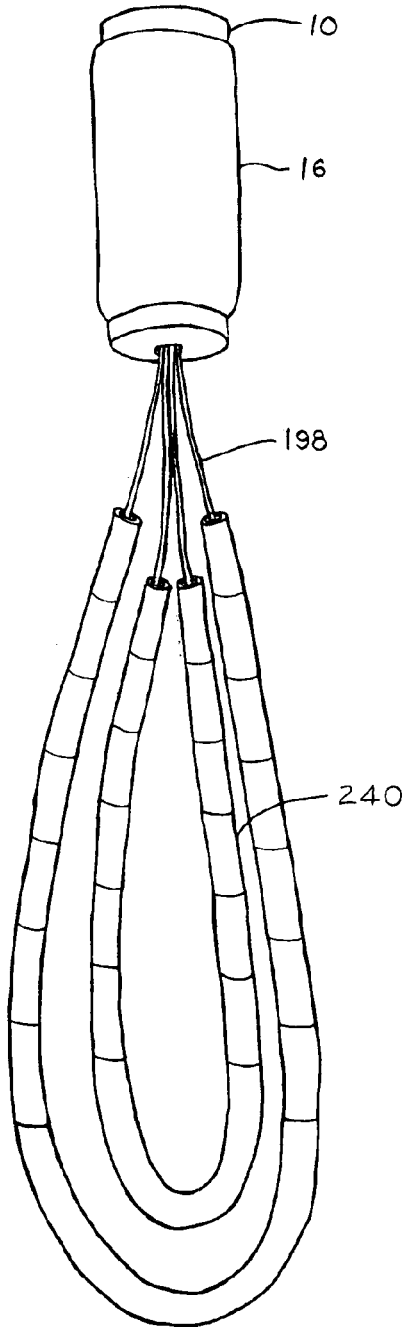
FIG. 7D shows another embodiment where a first loop 198 and a loop 240 are attached or connect to the handle 10.

FIG. 7D shows another embodiment where a first loop 198 and a second loop 240 are attached or connected to the handle 10. The first loop 198 and a second loop 240 can be formed from one cord or a plurality of cords. The cords can have outer casings of beads and/or rubber portions.

Fourth Configuration Option—Elongated Elements without Loops

In the fourth configuration option (see e.g., FIG. 8D) the jump rope simulator does not have loops. The units are each comprised of: (1) a handle, (2) an elongated first element attached to the handle. The elongated element provides weight and air resistance during the rotation of the elongated first element. FIG. 8B shows the elongated first element comprised of a first cord 308 attached to the handle 10 and a soft flexible element 310 surrounding a portion of the first cord.

FIGS. 8A to 8D show embodiments of the invention comprised of: (1) a handle, (2) an elongated first element attached to the handle. The elongated element provides weight and air resistance during the rotation of the elongated first element.

FIG. 8A shows an embodiment where the elongated first element is comprised of a first cord 300 attached to the handle 10 and a soft flexible element 304 attached to the first cord. The soft flexible element can be comprised of rubber, foam, coated foam or other suitable material.

FIG. 8B shows an embodiment where the elongated first element is comprised a first cord 308 attached to the handle 10 and a soft flexible element 310 surrounding a portion of the first cord 308. A washer 312 and knot 314 or other suitable attachment means can secure the flexible element 310 to the cord.

FIG. 8C shows an embodiment where the elongated first element is comprised of a first cord 316 attached to the handle 10 and a plurality of soft flexible elements 318 surround a portion of the first cord 316. A washer 320 and metal cord coupler 322 or other suitable attachment means can secure the flexible elements 318 to the cord.

FIG. 8D shows an embodiment where the elongated first element is comprised of an elongated first element 326 attached to the handle 10. The elongated first element 326 is preferably a cord or rope.

Dimensions for all Embodiments

The handles can preferably have a length of between 3 and 5 inches.

For embodiments that have loops, the loops preferably have a length from the handle to the furthermost point of the elongated element that is between 10 and 24 inches and more preferably a length of 16 and 20 inches.

The units preferably have a distance from the handle to the furthermost point of the elongated first element that is less than the length of the arm of the user; whereby the elongated first element should not strike the user in the head during use.

Operation of the Virtual Jump Rope

The virtual jump rope can be used similarly to a regular jump rope except the simulated jump rope does not require a jump rope to travel under the user's feet. The virtual jump rope provides basically the same level of exercise as a regular jump rope when these devices are used in a similar fashion. The exersion required to twirl one long regular jump rope, which is divided between the two handles, is basically equal to the exersion required to twirl the two separate units of the virtual jump rope.

In addition to performing the exercise capabilities of a regular jump rope, the virtual jump rope provides numerous additional movements and capabilities. Additional movements that can be performed with the invention's virtual jump rope include leg squats, lunges, high stepping, kicking movements such as to the side, front or back, use with an aerobic step device, use with walking, jogging, or running exercise, jumping to tip toes or flexing of legs without the user's feet leaving the ground. Also, whereas a regular jump rope allows only one basic arm movement, the virtual jump rope allows many different arm movements, including holding the arms at different positions such as far away from the body, different heights such as shoulder height, movements such as making large circles with the entire arm, and arm movements that can be out of synch with leg movements.

Advantages of the Invention

The jump rope simulator of the present invention provides many benefits over conventional jump ropes and prior art jump rope simulators.

Embodiments of the invention do not have a rope go under the user's feet as with a traditional jump rope, so there is no cord to get caught on the user's feet, and users do not have to stop and restart their exercise.

The jump rope simulator of the present invention provides superior performance and the realistic feel of a traditional jump rope. The loops of each unit are dual small arcs that perform equally well as the large single arc of a traditional jump rope. The loops of the invention provide a feel similar to a traditional jump rope, and provide a superior feel in contrast to the loopless simulators of the prior art. Another advantage of the embodiments of the invention are that the weight and wind resistance of the elongated element can be easily adjusted by changing the length of the loop, the number of loops or cords, the number of beads or soft outer coverings, etc. These are major advantages of the invention.

The jump rope simulator of the present invention provides an exercise workout simulating the jumping of a jump rope. Also, the jump rope simulator provides a total body workout with a wide range of intensity levels and with numerous additional arm & leg exercises. Leg movements include but are not limited to leg squats, lunges, high stepping movements, use with an aerobic step device, use with walking, jogging or running exercise, leg movements that can be out of synch with arm movements, jumping up on tip toes or flexing of legs without the user's feet leaving the ground; and the many different arm movements include holding the arms at different positions such as close to or far from the body, keeping hands at different heights such as shoulder height, and movements such as making large circles with the entire arm instead of just normal wrist movements of jumping rope.

Another advantage of the embodiments of the invention is that they have evenly weighted cords. That is, the weight is evenly distributed along the cord. This gives an improved feel and improved control when twirling the cord, and the cord does not hurt the user if the cord accidentally strikes the user since the impact is spread evenly. In contrast, some of the prior art simulators have weights or objects on the end of cords, and cords that are long in comparison to this invention. These end weights at the end of the relatively long cords of the prior art do not have as good of control and can harm the user if they strike the user.

Some embodiments of the invention have loops. These loops effectively reduce the overall device length (from handle to end of cord) by at least 50%. This design allows the device's length to be less than the users arm length thereby preventing the user from being struck in the face or head when using the invention.

The embodiments of the invention are relatively easy to manufacture, a major improvement over the prior art. The virtual jump rope, in all its loop embodiments, uses the same handle and cord materials that are used in traditional jump ropes. The main differences being a few new loop forming devices and associated manufacturing/assembly steps. So, current jump rope manufacturers could easily augment their operations to make virtual jump ropes.

The embodiments of the invention are easy and fun to use by users of all ages and all fitness levels. It is simple enough for children to use. Moreover, it would be great for older users, who could get an aerobic workout without the dangers of a regular jump rope. With no rope traveling under their feet, there would not be the danger of falling from tripping on a jump rope. Also, older users do not need to jump off the ground, which provides additional safety and results in little or no stress on older users' knees and joints. So, this invention provides a safe and effective workout for older users. Since older users are a large and growing segment of the population, and one that has limited exercise options, the virtual jump rope's advantages here are very significant.

Another advantage of the embodiments of the invention is that they can be used in aerobics or group exercise classes because the invention does not need a large amount of space between exercisers and it is not dangerous if it hits someone.

The word "attached" can mean connected where the connection can be unconnected or connected by a user.

Unless explicitly stated otherwise, each numerical value and range should be interpreted as being approximate as if the word "about" or "approximately" preceded the value or range.

While the invention has been particularly shown and described with reference to the preferred embodiments thereof, it will be understood by those skilled in the art that various changes in form and details may be made without departing from the spirit and scope of the invention. It is intended to cover various modifications and similar arrangements and procedures, and the scope of the appended claims therefore should be accorded the broadest interpretation so as to encompass all such modifications and similar arrangements and procedures.

What is claimed is:

1. An exercising device that is held and rotated in use comprised a unit;

said unit comprised of: a handle, a first chord attached to said handle, said first chord has a first end and a second end; only said first end of said first chord is attached to said handle; a first loop formed by attaching a first section of said first chord to a second section of said first chord using a first loop forming device; said first loop forming device is a first knot; said first loop entirely outside of said handle;

a elongated second element attached to said first loop by said first knot and a second knot.

2. The exercise device of claim 1, wherein said elongated second element is attached to said first loop by said first knot and a second knot; said first knot is a bowline knot;

said elongated second element is a section of said first elongated element;

said first knot and said second knot located at about opposite sides of said first loop.

3. The exercise device of claim 1 wherein said first loop and said elongated second element are at least partially covered by a tubular element; said tubular element maintains a spread-open "U" shape at the end of said first loop.

4. The exercise device of claim 1 wherein the distance between said first loop forming device and said handle is less than about 2.5 inches; and the distance from the bottom of the handle and the furthermost point of said first elongated element is between 10 and 24 inches.

5. An exercising device comprised of a unit comprised of:

a handle, an elongated first element attached to said handle, and said elongated first element has at least a first loop; said first loop formed by a first loop forming device; said first loop is entirely outside of said handle;

a first segment of said elongated first element that is not part of said first loop, is between said handle and said first loop;

an elongated second element attached directly to said first loop forming device;

said elongated second element attached to said first loop only by said first loop forming device and a second loop forming device;

said first loop forming device and said second loop forming device located at about opposite sides of said first loop;

said first and said second loop forming devices are knots.

6. The exercise device of claim 5 which further includes:

the distance between said first loop forming device and said handle is less than about 2.5 inches; and the distance from the bottom of the handle and the furthermost point of said first elongated element is between 10 and 24 inches.

* * * * *